US006527480B2

(12) United States Patent
Angelini et al.

(10) Patent No.: US 6,527,480 B2
(45) Date of Patent: Mar. 4, 2003

(54) BUOYANCY COMPENSATOR WEIGHT SYSTEM

(75) Inventors: Sergio A. Angelini, San Diego, CA (US); Robert M. Carmichael, Fort Lauderdale, FL (US)

(73) Assignee: Johnson Outdoors Inc., Racine, WA (US)

( * ) Notice: Subject to any disclaimer, the term of this patent is extended or adjusted under 35 U.S.C. 154(b) by 0 days.

(21) Appl. No.: 09/916,414

(22) Filed: Jul. 26, 2001

(65) Prior Publication Data

US 2002/0013107 A1 Jan. 31, 2002

Related U.S. Application Data

(63) Continuation of application No. 09/628,836, filed on Jul. 31, 2000.

(51) Int. Cl.[7] ..... B63C 11/30

(52) U.S. Cl. ..... 405/186; 441/88; 441/106

(58) Field of Search ..... 405/186, 185; 441/102, 106, 111, 114, 115, 116, 117, 118, 119, 88, 80

(56) References Cited

U.S. PATENT DOCUMENTS

| | | | | | |
|---|---|---|---|---|---|
| 4,694,772 | A | * | 9/1987 | Faulconer et al. | 405/186 |
| 5,074,714 | A | * | 12/1991 | Franco | 405/186 |
| 5,205,672 | A | * | 4/1993 | Stinton | 405/186 |
| 5,516,234 | A | * | 5/1996 | Duchesne | 405/186 |
| 5,746,542 | A | * | 5/1998 | Carmichael | 405/186 |
| 5,860,769 | A | * | 1/1999 | Seligman | 405/186 |
| 5,944,450 | A | * | 8/1999 | Anderson | 405/186 |
| 6,030,147 | A | * | 2/2000 | Bowden | 405/186 |

OTHER PUBLICATIONS

Halcyon Internet Web page, titled "Active Control Ballast", at URL http:/www.halcyon.net/mc/06a_mc.shtml. downloaded on Aug. 22, 2000 and Aug. 28, 2001.*

* cited by examiner

*Primary Examiner*—S. Joseph Morano
*Assistant Examiner*—Ajay Vasudeva
(74) *Attorney, Agent, or Firm*—Foley & Lardner

(57) ABSTRACT

A buoyancy control system includes an apparel unit worn by a user and including a front panel, a pocket along the front panel having an interior, a weight pouch configured to hold at least one weight and removably received within the interior of the pocket, a first connector portion coupled to the weight pouch and a second connector portion released the couple to the first connector portion. The first and second connector portions form a mechanical lock actuatable between a connected state in which the lock connects a weight pouch to the apparel unit and a disconnected state in which a weight pouch may be removed from the weight pocket by a single manipulation step of the hand of the diver. In one exemplary embodiment, the device further includes an elastic band coupled between the apparel unit and the second connector. The band biases the second connector portion away from the first connector portion such that the band pulls the second connector portion away from the first connector portion upon release of the first and second connector portions. In one exemplary embodiment, the first connector portion and second connector portion comprise a side release connector such that the male prongs of the side release connector, upon being depressed inwardly, eject the second connector portion from the first connector. In one exemplary embodiment, a buckle and a strap couple the first connector portion to the weight pouch. Adjustment of the length of the strap between the buckle and the weight pouch moves the weight pouch within the weight pocket while the first and second connector portions are in the connected state.

33 Claims, 2 Drawing Sheets

FIG. 1
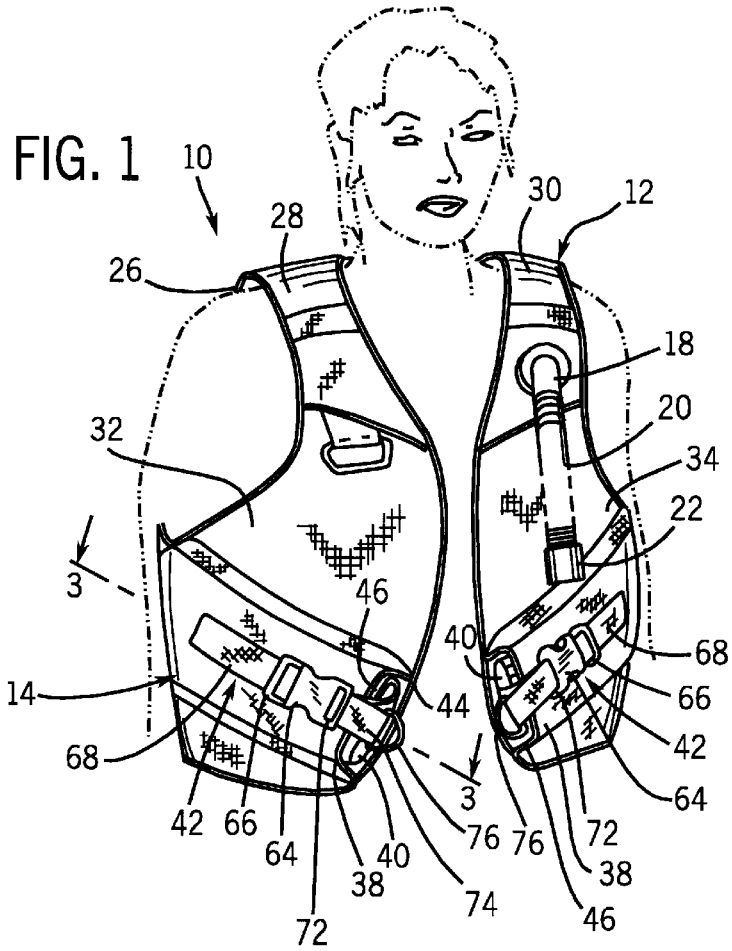
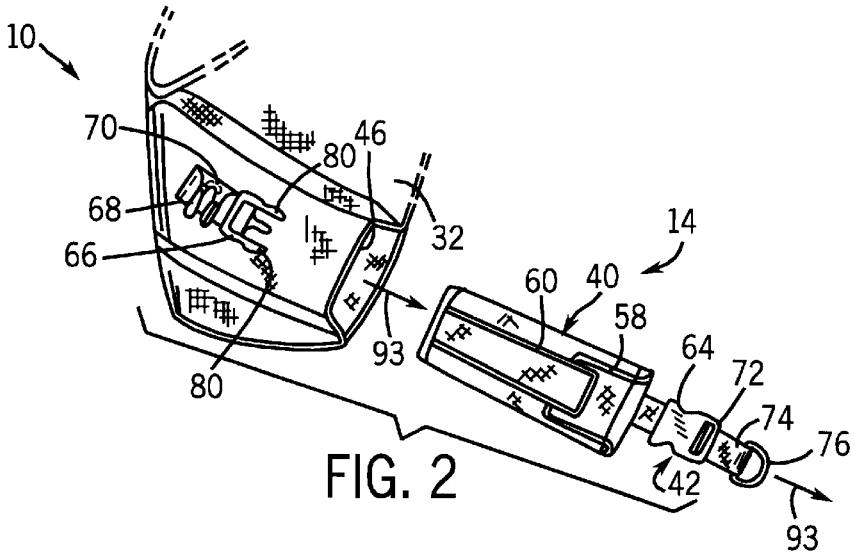
FIG. 2

BUOYANCY COMPENSATOR WEIGHT SYSTEM

CROSS REFERENCE TO RELATED APPLICATION

This continuing application claims priority under 35 U.S.C. §120 from U.S. patent application Ser. No. 09/628,836 filed on Jul. 31, 2000 and entitled BUOYANCY COMPENSATOR WEIGHT SYSTEM, the full disclosure of which is hereby incorporated by reference.

FIELD OF THE INVENTION

The present invention relates to buoyancy compensating devices used in underwater diving. In particular, the present invention relates to systems for containing and allowing selective release of weight to adjust buoyancy provided by the system.

BACKGROUND OF THE INVENTION

A buoyancy control device, more commonly known as a buoyancy compensator, is a standard piece of equipment used by scuba divers to help offset changes in buoyancy during the course of a dive. The buoyancy of a scuba diver during a dive can depend on a number of factors, such as the weight of the diver, the weight of the equipment carried by the diver, the depth of the dive, the temperature of the water, and numerous other factors. Consequently, the buoyancy of the diver can vary significantly during the course of a dive or between dives. A buoyancy compensator helps to offset these changes in buoyancy, thereby making it easier for the diver to maintain or achieve a desired depth. In addition to allowing fine tuning of buoyancy while the diver is underwater, a good buoyancy compensator allows easy surface swimming, stowing of small accessories, and organization of hoses and alternate gas sources. It also helps the diver to streamline his equipment by providing storage pockets and instrument attachment points.

A buoyancy compensator is typically a vest-like harness that is worn around the diver's torso. It generally includes four major elements: a weighting or weight system, an adjustable gas cell, a means of securing a gas tank, and storage pockets. The weighting system is typically made up of lead weights that are attached about the waist of the diver on a weight belt or contained within pockets mounted at the side panels of the buoyancy control device. The weighting system is used to overcome the buoyancy force exerted on the diver by the water, which then allows the diver to sink. In emergency situations, the weights of the weighting system are removed and dropped such that the diver quickly ascends.

The gas cell performs a function opposite to that of the weighting system. It is used to increase the buoyancy force exerted by the water, which offsets the negative forces exerted by the weight of the diver and his equipment, thereby assisting the diver to float towards the surface. Inflating the gas cell increases the buoyancy force acting on the diver, and can be done by connecting the gas cell to the gas tank via a valve and a hose and allowing the compressed gas in the gas tank to fill the gas cell, or it can be done by orally inflating the cell by blowing into a hose connected to the gas cell. The weighting system and the gas cell can also be used together to create a condition of equilibrium that allows the diver to maintain a desired depth. The means of securing a gas tank is used to prevent the gas tank from shifting or moving relative to the diver. This helps to ensure a more controlled dive, especially in tight quarters. Pockets are also included in buoyancy compensators because divers need storage compartments for a variety of reasons.

Those weighting systems which utilize pockets along the side panels of the buoyancy control device to contain weights come in a variety of configurations. Many weighting systems employ upwardly facing pockets to contain the weights or to contain pouches containing the weights. Although easy to load, such pockets are difficult to unload. Other weighting systems employ downwardly oriented pockets or sideways oriented pockets in which pouches containing weights are positioned. Such pouches are usually releasably retained within the pocket by means of a hook and loop fastener (VELCRO). In an emergency situation, the pouches containing the weights are removed and released by simply separating the hook and loop components of the hook and loop fastener, allowing the weight pouch to be removed from the pocket and to be dropped such that the diver immediately ascends. In other instances, the pouches and the weights are removed from the pocket and handed to a diving instructor or to another individual on a watercraft to allow the diver to more easily exit the water and board the watercraft.

Although such weight systems employing sideways or downwardly oriented pockets containing weight carrying pouches are generally preferred over upwardly oriented pockets, such weighting systems have several drawbacks. First, complete insertion of the weight containing pouch into the pocket is many times difficult due to gravity and friction between the pouch and the interior of the pocket. However, incomplete insertion of the weight pouch into the pocket results in the buoyancy control device being improperly configured which creates discomfort to the user wearing the buoyancy control device and instability. Moreover, incomplete insertion and securement of the weight pouch into the pocket may result in the hook and loop fastener becoming accidentally disconnected and may result in the pouch accidentally becoming dislodged from the pocket as a result of the repeated reciprocation of the weight pouch in the pocket.

Once the user is in the water, it is often easier for the user to readjust the position of the weight pouch in the pocket. Such readjustment generally requires that the hook and loop fastener be disconnected so as to allow the weight pouch to be more completely inserted into the weight pocket. Unfortunately, disconnection of the hook and loop fastener securing the weight pouch to the weight pocket while the user is in the water frequently results in the weight pouch being accidentally dropped and lost.

A second disadvantage associated with such existing weighting systems employing sidewards or downwardly oriented pockets and weight pouches is that such systems are difficult to operate in time critical situations and have durability concerns. In particular, the hook and loop fasteners commonly employed to secure the weight pouches in the weight pockets are susceptible to wear over time and have limited strength. As a result, the weight pouches may fall out of the pockets. The use of other connectors generally requires multiple steps or hand manipulations to disconnect the weight pouches from the pockets. In many underwater diving situations, the user simply does not have time or the required dexterity to perform such multiple steps to release the pouches from the pockets. The multiple steps necessary to release the pouches from the pockets is often made more difficult by the movement retarding thick wetsuit or drysuit worn by the diver.

Thus, there is a continuing need for a buoyancy control device and a weighting system for a buoyancy control device that: (1) enables a weight pouch to be completely inserted into the weight pocket without the risk of the weight pouch being accidentally dropped, (2) that more durably secures the weight pouch to and within the weight pocket, and (3) that enables the user to quickly and easily release the weight pouch from the weight pocket in few steps or hand manipulations and without the risk of the weight pouch being unintentionally dropped.

SUMMARY OF THE INVENTION

According to one embodiment, a buoyancy control system includes an apparel unit adapted to be worn by a diver. The apparel unit includes a front panel, a pocket along the front panel having an interior and exterior surface defining an opening communicating with the interior. The system further includes a weight pouch configured to hold at least one weight and removably received within the interior of the pocket, a first connector portion coupled to the weight pouch, a second connector portion releasably coupled to the first connector portion and an elastic member having a first portion coupled to the apparel unit and a second portion coupled to the second connector. The member biases second connector portion away from the first connector portion such that the band pulls the second connector portion away from the first connector portion upon release of the first and second connector portions.

According to another embodiment, a buoyancy control system includes an apparel unit adapted to be worn by a diver including a front panel, a pocket along the front panel having an interior and an exterior surface defining an opening communicating with the interior, a weight pouch configured to hold at least one weight and removably received within the interior of the pocket and an insertion assist mechanism coupled to the weight pouch and apparel unit. The insertion assist mechanism has a selectively adjustable length to move the pouch within the pocket.

According to another embodiment, a buoyancy control system includes an apparel unit adapted to be worn by a diver, a pocket along a front panel of the apparel unit and having an interior and an exterior surface defining an opening communicating with the interior, a weight pouch configured to hold at least one weight and removably received within the interior of the pocket and a mechanical lock coupled between the weight pouch and the apparel unit. The mechanical lock is actuatable between a connected state in which the lock connects the weight pouch to the apparel unit and a disconnected state in which the weight pouch may be removed from the weight pocket by single manipulation step of the hand of the diver.

BRIEF DESCRIPTION OF THE DRAWINGS

FIG. 1 is a perspective view of a buoyancy control device including a weighting system and retaining system of the present invention.

FIG. 2 is an enlarged fragmentary view of the buoyancy control device of FIG. 1 illustrating a weight pouch and weight being removed from a weight pocket of the buoyancy control device.

DETAILED DESCRIPTION OF THE PREFERRED EMBODIMENTS

Figure 3:
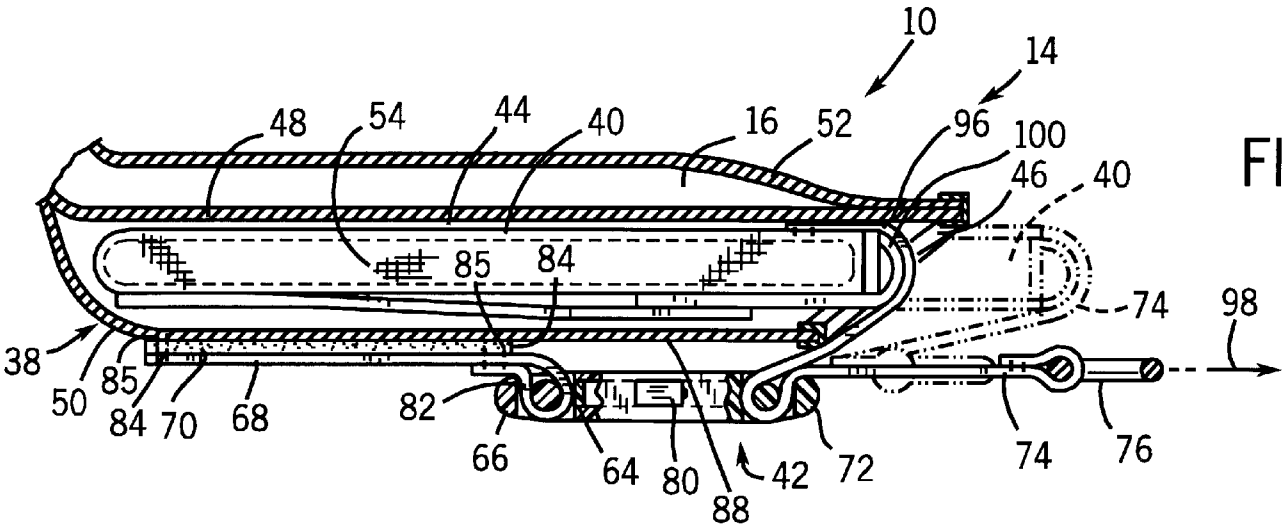
FIG. 3 is a section of the buoyancy control device of FIG. 1 taken along lines 3—3 illustrating repositioning of the weight pouch from an incomplete inserted position shown in phantom to a completely inserted position shown in solid.

FIGS. 1–4 illustrate buoyancy control device 10. FIG. 1 illustrates buoyancy control device 10 being worn by a diver. Buoyancy control device 10 generally includes apparel unit 12 and weighting systems 14. Apparel unit 12 is configured to be worn by the diver and provides an adjustable gas cell 16 (shown in FIG. 3) which may be selectively inflated or deflated to adjust a buoyancy of the user during a dive. To allow for such adjustment, apparel unit 12 generally includes the means for inflating and deflating gas cell 16. Such means preferably include elbow tube 18, inflator hose 20 and mouth piece 22. Elbow tube 18 is in communication with gas cell 16 and is connected to inflator hose 20. Inflator hose 20 is connected to mouth piece 22. Mouth piece 22 enables the user to inflate gas cell 40 orally by channeling air blown into the mouth piece into gas cell 16. Mouth piece 22 includes a valve mechanism which allows the user to release gas from cell 16 by pushing a button. Various other conventionally known means for selectively inflating and deflating gas cell 16 may be provided in apparel unit 12.

Although not shown, apparel unit 10 additionally includes a tank mounting mechanism such as that described in copending U.S. patent application Ser. No. 09/629,604, entitled Buoyancy Control Device Storage Pockets, filed on Jul. 31, 2000 by Sergio A. Angelini, the full disclosure which, in its entirety, is hereby incorporated by reference.

In an exemplary embodiment, apparel unit 12 is in form of a vest including a back panel 26, a right shoulder strap 28, a left shoulder strap 30, a right front panel 32 and a left front panel 34. Back panel 26 is a panel that covers the diver's back when buoyancy control device 10 is worn by the diver. Back panel 26 is connected to right and left shoulder straps 28 and 30 and right and left from panels 32, 34.

In alternative embodiments, buoyancy control for apparel unit 12 may be in the form of a pull-over rather than a vest. Instead of having a right and left panel, apparel unit 12 may have one front panel that is attached to each side of back panel 26 and covers the area of the divers body that both right front panel 32 and left panel 34 are shown covering in FIG. 1. In such a one front panel configuration, apparel unit 10 is pulled down over the diver's head. In another embodiment, apparel unit 12 includes only a single right or left panel. In such an embodiment, rather than having a front panel extend from each side of the back panel 26 and terminate near the center of the divers torso, and show in FIG. 1, the single right or left panel extends from one side of back panel 26 and terminates on the other side of back panel 26. In yet another alternative embodiment, apparel unit 12 includes a right and left front panel, but the right and left front panel do not necessarily terminate near the center or mid-sagital plane of the diver's body. As will now be appreciated, apparel unit 10 may have a variety of different configurations enabling buoyancy control of device 12 to be worn by the diver.

Weighting systems 14 are integrated into apparel unit 12 and enable the user or diver to compensate for excess positive buoyancy (given by wetsuit/drysuit and/or natural body composition) prior to a dive by adding a proper amount of weights. They also allow quick release in case of an emergency. Weighting systems 14 are disposed on each of right panel 32 and left front panel 34 and are substantially identical to one another. For ease of discussion, weighting system 14 on front panel 32 is discussed. Weighting system 14 generally includes pocket 38, weight pouch 40 and retaining system 42. Pocket 38 extends along front panel 32 and defines an interior 44 sized to receive weight pouch 40 and an opening 46 through which weight pouch 40 is inserted into interior 44. In the exemplary embodiment, interior 44 and opening 46 are oriented in a downward direction when device 10 is being worn by the diver. As a result, weight pouch 40 and weight 54 within weight pouch 40 can be removed from interior 44 and released.

As best shown by FIG. 3, pocket 38 is preferably formed by panels 48 and 50 which are sewn together to define interior 44 and opening 46. As further shown by FIG. 3, panel 48 is secured to panel 52 by stitching or other securement means to form the airtight gas cell 16. As will be appreciated, the volume providing gas cell 16 and the volume providing pocket 38 may be formed by greater or fewer component panels secured to one another in any of variety of different ways.

Weight pouch 40 contains a removable weight 54 and is sized to be removably positioned within interior 44 of pocket 38. In the exemplary embodiment, weight pouch 40 includes a pair of flaps 58, 60 which are releasably secured to one another to close an opening (not shown) through which weights are positioned in weight pouch 40. As will be appreciated, weight pouch may have any of a variety of alternative size, shapes and configurations, as well as closing mechanisms, so long as weight pouch 40 is removably positioned within interior 44 of pocket 38.

Retaining system 42 releasably retains weight pouch 40 and its weight 54 within interior 44 of pocket 38. Retaining system 42 generally includes connector portion 64, connector portion 66, band 68, band 70 (shown in FIG. 3), buckle 72, strap 74 and ring 76. Connector portion 64 is coupled to weight pouch 40 while connector portion 66 is coupled to apparel unit 12. Connector portions 64 and 66 are configured to be releasably connected to one another so as to releasably secure weight pouch 40 to apparel unit 12. Connector portions 64 and 66 form a mechanical lock which is actuatable between a connected state and a disconnected state by a single manipulation step whereby connector portions 64 and 66 may be disconnected without requiring that the hand of the user be repositioned multiple times to perform multiple manipulations. In the exemplary embodiment, connector portions 64 and 66 comprise a conventionally known side-release connector, whereby connector portions 64 and 66 may be disconnected from one another by simply pinching or squeezing prongs 80 inwardly. Upon connector portions 64 and 66 being disconnected, prongs 80 apply resilient force to the other of the connector so as to eject themselves from the other of the connector.

In the exemplary embodiment, connector portion 66 comprises a male portion of a side release connector while connector portion 64 comprises a female portion of a side release connector which receives connector portion 66. Because connector portion 64 preferably comprises the female portion of a side-release connector, the user's hand remains gripped about connector portion 64 rather than connector portion 66 upon connector portions 64 and 66 being disconnected. Since connector portion 64 is coupled to weight pouch 40, this arrangement further enables the diver to keep control of weight pouch 40. As a result, the diver may more easily pull and withdraw weight pouch 40 from pocket 38 to release and drop weight pouch 40 during a dive or may more easily withdraw weight pouch 40 from pocket 38 to hand weight pouch 40 to a diving instructor or another person on board a water craft as the water craft is being boarded by the diver after a dive to enable the diver to more easily board the water craft.

Although less desirable, connector portion 66 may alternatively comprise a female portion of a side release connector and connector portion 64 may alternatively comprise a male portion of a side release connector. Moreover, connector portions 64 and 66 may comprise other conventionally known mechanical locks which are actuatable from a connected state to a disconnected state by means of a single manipulation step. Because connector portions 64 and 66 form a mechanical lock releasable securing weight pouch 40 to apparel unit 12, weight pouch 40 is better retained within pocket 38 since the mechanical lock provided by connector portions 64 and 66 is more durable and wear resistant than conventionally-used hook and loop fastener arrangements. At the same time, because connector portions 64 and 66 provide a mechanical lock that is actuatable from the connected state to the disconnected state through a single manipulation step, weight pouch 40 and its weight 54 may be more easily uncoupled or disconnected from apparel unit 12 and released to adjust the buoyancy of the diver. This is especially important in emergency situations.

Figure 4:
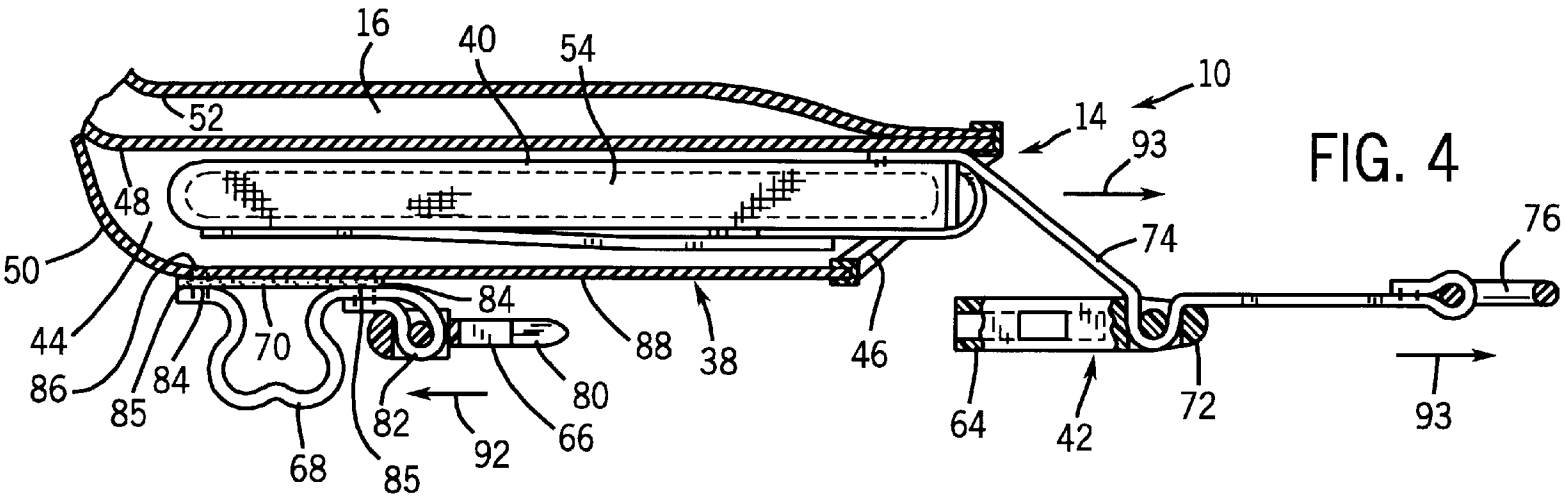
FIG. 4 is a sectional view of the buoyancy control device of FIG. 1 taken along lines 3—3 illustrating connector portions of the retaining system in a disconnected state and further illustrating removal of the weight pouch from the weight pocket.

Bands 68 and 70 are coupled to connector portion 66 and to apparel unit 12. Bands 68 and 70 are best shown in FIGS. 3 and 4. Band 68 comprises a length of material having a first portion 82 coupled to connector portion 66 and at least one portion 84 coupled to band 70. Band 68 is formed from a generally inelastic material such as nylon.

Band 70 extends adjacent to band 68 and has a first portion 85 coupled to band 68 and a second portion 86 coupled to apparel unit 12. An exemplary embodiment, portion 86 is stitched to an exterior surface 88 of panel 50 of pocket 38. Band 70 is formed from an elastic material and is preferably coupled to apparel unit 12 such that band 70 is stretched when connector portions 64 and 66 are in the connected state as shown in FIG. 3. As shown in FIGS. 2 and 4, upon disconnection of connector portions 64 and 66, band 70 resiliently returns to its initial length. As a result, band 70 further assists in the ejection of connector portion 66 from connector portion 64 to ensure a complete separation of connector portions 64 and 66. As shown in FIGS. 2 and 4, band 70 resiliently returns to its initial length, causing connector portion 66 to be withdrawn away from connector portion 64 in the direction indicated by arrow 92. This complete separation of connector portions 64 and 66 enables the diver to more reliably grasp connector portion 64 to pull weight pouch 40 and its weight 54 from pocket 38 in the direction indicated by arrow 93 and minimizes the need for visual confirmation by the diver to ensure that the diver is not accidentally grasping connector portion 66.

Although retaining system 42 is illustrated as including bands 68 and 70, retaining system 42 may alternatively include other members in lieu of bands 68 and 70. For example, bands 68 and 70 may alternatively be replaced with webbing or a combination of a band and webbing. Although less desirable, band 68 and elastic band 70 may be replaced with a single elastic band having a first portion secured to connector portion 66 and a second portion secured to apparel unit 12. Although less desirable, elastic band 70 may be omitted such that band 68 secures connector portion 66 to apparel unit 12 or such that connector portion 66 is secured directly to apparel unit 12. In such an alternative embodiment, the resilient prongs 80 of connector portion 66 act against connector portion 64 upon being inwardly squeezed to eject connector portion 66 away from connector portion 64.

Buckle 72 and strap 74 serve as an insertion assist to facilitate complete insertion of weight pouch 40 into interior 44 of pocket 38. Buckle 72 is preferably integrally formed as a single unitary body with connector portion 64. Alternatively, buckle 72 may be provided as a separate independent component which is itself strapped or otherwise secured to connector portion 64.

Strap 74 is an elongate band or webbing having a first end 96 coupled to weight pouch 40 and a second opposite end threaded through buckle 72 and secured to ring 76. Strap 74 couples weight pouch 40 to buckle 72 which is in turn coupled to connector portion 64. Strap 74 has a first length extending between weight pouch 40 and buckle 72 and a second length extending beyond buckle 72 and ending at ring 76. Ring 76 preferably comprises a D-ring and facilitates grasping and pulling of strap 74. As will be appreciated, ring 76 may be replaced with any other variety of alternative structures which serve as a handle for enabling strap 74 to be grasped. Ring 76 further prevents complete withdrawal of strap 74 from buckle 72. Although less desirable, ring 76 may be omitted, wherein strap 74 is directly grasped by the diver.

As shown in FIG. 3, the movement of weight pouch 40 from the incompletely inserted position shown in phantom to the completely inserted position shown in solid may be achieved by simply pulling strap 74 in the direction indicated by arrow 98. In particular, pulling strap 74 in the direction indicated by arrow 98 lengthens the second length of strap 74 extending between buckle 72 and ring 76 and shortens the length of strap 74 extending between weight pouch 40 and buckle 72. As the first distance of strap 74 between buckle 72 and weight pouch 40 is shortened, the length of strap 74 most closely adjacent to weight pouch 96 is drawn towards buckle 72 to also draw end 100 of weight pouch 40 towards buckle 72. As a result, pulling strap 74 through buckle 72 moves weight pouch 40 towards the back of pocket 38 to assist in the complete insertion of weight pouch 40 and its weight 54 into interior 44 of pocket 38. This can be accomplished while connector portions 64 and 66 remain in the connected state and while weight pouch 40 remains connected to apparel unit 12. Unlike conventional hook and loop fastener systems, retaining system 42 enables the extent of insertion of weight pouch 40 in pocket 38 to be adjusted without the risk of weight pouch 40 accidentally falling out of pocket 38 during such adjustment. Although less desirable, buckle 72 and strap 74 may alternatively be replaced with a simple strap having a first end connected to weight pouch 40 and a second end connected to connector portion 64.

Overall, retaining system 42 of weighting system 14 provides a more durable and easier to use weighting system. In particular, buckle 72 and strap 74 enable the position of the weight pouch 40 and weight 54 to be adjusted and to be more completely inserted into pocket 38 without the risk of weight pouch 40 being accidentally dropped. Because connector portions 66 and 64 form a mechanical lock securing weight pouch 40 to apparel unit 12, this securement of pouch 42 of apparel unit 12 is more durable as compared to conventional hook and loop fasteners arrangements. Because connector portions 64 and 66 actuate from a connected to a disconnected state with a single manipulation step, the user does not need to reposition his or her hands, allowing faster and more reliable disconnection and removal of the weight pouch from the pocket with a reduced risk of the weight pouch being unintentionally dropped.

Although the present invention has been described with reference to preferred embodiments, workers skilled in the art will recognize that changes may be made in form and detail without departing from the spirit and scope of the invention. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A buoyancy control system comprising:

an apparel unit adapted to be worn by a diver, the apparel unit including a panel;

a pocket along the panel, the pocket having an interior and an exterior surface defining an opening communicating with the interior;

a weight pouch configured to hold at least one weight and removably received within the interior of the pocket;

a first connector portion coupled to the weight pouch;

a second connector portion releasably coupled to the first connector portion; and an elastic band coup led between the apparel unit and the second connector portion, wherein the band biases the second connector portion away from the first connector portion such that the band pulls the second connector portion away from the first connector portion upon release of the first and second connector portions.

2. The system of claim 1, including an insertion mechanism coupled between the weight pouch and the first connector portion, the mechanism having a selectively adjustable length to move the pouch in the pocket.

3. The system of claim 2, wherein the mechanism comprises a buckle coupled to the first connector portion and a strap coupled to the weight pouch and threaded through the buckle.

4. The system of claim 1, wherein the first connector portion comprises a female portion of a side release connector and wherein the second connector portion comprises a male portion of the side release connector.

5. The system of claim 1, wherein the elastic band is coupled to the exterior surface of the pocket.

6. The system of claim 1, wherein the opening faces in a sideways direction.

7. The system of claim 1, including a gas cell formed in the apparel unit and configured to retain gas to provide the apparel unit with buoyancy.

8. The system of claim 7, including means for selectively inflating and deflating the gas cell to adjust the buoyancy of the apparel unit.

9. The system of claim 1, wherein the apparel unit comprises a vest.

10. A buoyancy control system comprising:

an apparel unit adapted to be worn by a diver, the apparel unit including a panel;

a pocket along the panel, the pocket having an interior and an exterior surface defining an opening communicating with the interior;

a weight pouch configured to hold at least one weight and removably received within the interior of the pocket;

a mechanical lock coupled between the weight pouch and the apparel unit, the mechanical lock being actuatable between a connected state in which the lock connects the weight pouch to the apparel unit and a disconnected state in which the weight pouch may be removed from the pocket by a single manipulation step of a hand of the diver; and a selectively inflatable and deflatable gas cell formed in the apparel unit to provide the apparel unit with an adjustable buoyancy.

11. The system of claim 10, wherein the mechanical lock includes a first connector portion coupled to the weight pouch and a second connector portion coupled to the apparel unit, wherein the first connector portion and the second connector portion are joined when the mechanical lock is in the connected state and wherein the first connector portion and the second connector portion are separated when the mechanical lock is in the disconnected state.

12. The system of claim 11, wherein one of the first connector portion and the second connector portion receives the other of the first connector portion and the second connector portion and wherein one of the first connector portion and the second connector portion ejects the other of the first connector portion and the second connector portion upon the mechanical lock being actuated to the disconnected state.

13. The system of claim 12, wherein the mechanical lock comprises a side-release connector.

14. The system of claim 12, wherein the first connector portion receives the second connector portion and wherein the second connector portion is ejected from the first connector portion when the mechanical lock is actuated to the disconnected state.

15. The system of claim 11, including an elastic band coupled between the apparel unit and the second connector, wherein the band biases the second connector portion away from the first connector portion such that the band pulls the second connector portion away from the first connector portion upon release of the first and second connector portions.

16. The system of claim 10, including an insertion assist mechanism coupled between the weight pouch and the first connector portion, the insertion assist mechanism having a selectively adjustable length to move the pouch in the pocket.

17. The system of claim 16, wherein the insertion assist mechanism comprises a buckle coupled to the first connector portion and a strap coupled to the weight pouch and threaded through the buckle.

18. The system of claim 10, wherein the apparel unit comprises a vest.

19. A buoyancy control system comprising:

an apparel unit adapted to be worn by a diver, the apparel unit including a panel;

a pocket along the panel, the pocket having an interior and an exterior surface defining an opening communicating with the interior;

a weight pouch configured to hold at least one weight and removably received within the interior of the pocket; and an insertion assist mechanism coupled to the weight pouch and the apparel unit, the mechanism having a selectively adjustable length to move the pouch in the pocket.

20. The system of claim 19, wherein the insertion assist mechanism is releasably coupled to the apparel unit.

21. The system of claim 19, wherein the insertion assist mechanism comprises a buckle coupled to the apparel unit and a strap coupled to the weight pouch and threaded through the buckle.

22. The system of claim 21, including a first connector portion coupled to the buckle and a second connector portion coupled to the apparel unit and releasably coupled to the second connector portion.

23. The system of claim 22, including an elastic band coupled between the apparel unit and the second connector portion, wherein the band biases the second connector portion away from the first connector portion such that the band pulls the second connector portion away from the first connector portion upon release of the first and second connector portions.

24. The system of claim 22, wherein the first connector portion comprises one of a male portion and a female portion of a side release connector and wherein the second connector portion comprises the other of the male portion and the female portion of the side-release connector.

25. The system of claim 24, wherein the first connector portion comprises the male portion of the side-release connector.

26. The system of claim 19, wherein the apparel unit comprises a vest.

27. A buoyancy control system comprising:

an apparel unit adapted to be worn by a diver, the apparel unit including a panel;

a pocket along the panel, the pocket having an interior and an exterior surface defining an opening communicating with the interior;

a weight removably positioned within the interior of the pocket; and a mechanical lock releasably coupling the weight to the apparel unit;

at least one first strap interconnecting the apparel and the mechanical lock, wherein the at least one first strap is elastic.

28. The system of claim 27, including a weight pouch removably receiving the weight and removably positioned within the pocket.

29. The system of claim 28 further comprising:

at least one second strap interconnecting the mechanical lock and the weight pouch.

30. The system of claim 29, wherein the mechanical lock comprises a side-release connector.

31. The system of claim 30, wherein the side-release connector includes a male portion coupled to the at least one first strap and a female portion coupled to the at least one second strap.

32. The system of claim 30, further comprising a weight pouch configured to hold the weight and removably received within the interior of the pocket.

33. The system of claim 32, including an insertion assist mechanism coupled to the weight pouch in the apparel unit, the mechanism having a selectively adjustable length to move the pouch in the pocket.

* * * * *

UNITED STATES PATENT AND TRADEMARK OFFICE

CERTIFICATE OF CORRECTION

PATENT NO. : 6,527,480 B2 
DATED : March 4, 2003
INVENTOR(S) : Sergio A. Angelini and Robert M. Carmichael It is certified that error appears in the above-identified patent and that said Letters Patent is hereby corrected as shown below:

Title page,
Item [73], Assignee, replace "Johnson Outdoors Inc., Racine, WA (US)" with
-- Johnson Outdoors Inc., Racine, WI (US) --

Column 8,
Line 19, replace the word "coup led" with -- coupled --

Signed and Sealed this

Twelfth Day of August, 2003

JAMES E. ROGAN
*Director of the United States Patent and Trademark Office*